US009616555B2

(12) United States Patent
Chartier et al.

(10) Patent No.: US 9,616,555 B2
(45) Date of Patent: Apr. 11, 2017

(54) BASIN WRENCH

(71) Applicant: Ridge Tool Company, Elyria, OH (US)

(72) Inventors: Glen R. Chartier, Avon Lake, OH (US); Harald Krondorfer, Aurora, OH (US); Robert Englert, Jamesville, NY (US)

(73) Assignee: Ridge Tool Company, Elyria, OH (US)

( * ) Notice: Subject to any disclaimer, the term of this patent is extended or adjusted under 35 U.S.C. 154(b) by 754 days.

(21) Appl. No.: 14/061,021

(22) Filed: Oct. 23, 2013

(65) Prior Publication Data

US 2014/0116206 A1 May 1, 2014

Related U.S. Application Data

(60) Provisional application No. 61/719,058, filed on Oct. 26, 2012.

(51) Int. Cl.

| | |
|---|---|
| ***B25B 23/16*** | (2006.01) |
| ***B25B 13/28*** | (2006.01) |
| ***B25B 13/48*** | (2006.01) |
| ***B25B 23/18*** | (2006.01) |
| ***B25G 1/00*** | (2006.01) |
| ***B25B 13/50*** | (2006.01) |

(52) U.S. Cl.

CPC ..... *B25B 13/481* (2013.01); *B25B 13/28* (2013.01); *B25B 13/505* (2013.01); *B25B 23/16* (2013.01); *B25B 23/18* (2013.01); *B25G 1/007* (2013.01)

(58) Field of Classification Search

CPC ..... B25B 13/481; B25B 13/28
USPC ..... 81/177.6, 177.7, 177.75
See application file for complete search history.

(56) References Cited

U.S. PATENT DOCUMENTS

| | | | | | |
|---|---|---|---|---|---|
| 1,795,048 | A | * | 3/1931 | Schuh | B25B 13/481 81/177.6 |
| 2,166,449 | A | * | 7/1939 | Sharpe | B25B 13/28 81/186 |
| 2,491,623 | A | | 12/1949 | Sesak | |
| 4,485,702 | A | * | 12/1984 | Swan | B25B 13/481 81/177.2 |
| 5,595,095 | A | * | 1/1997 | Hillinger | B25B 13/461 81/58.3 |
| 6,135,607 | A | * | 10/2000 | Cook | B25B 23/0021 362/109 |

(Continued)

FOREIGN PATENT DOCUMENTS

WO 2005030440 4/2005

OTHER PUBLICATIONS

International Search Report (ISR) and Written Opinion, PCT/US2013/066760, Mar. 18, 2014, 16 pages.

(Continued)

*Primary Examiner* — Bryan R Muller
(74) *Attorney, Agent, or Firm* — Mark E. Bandy; Rankin, Hill & Clark LLP

(57) ABSTRACT

A basin wrench is described having a telescoping assembly, pivotal jaws, a light, and a removable T-bar assembly. The wrench includes a polymeric housing having a contoured gripping region. The T-bar assembly includes a pivotally mounted hub and bar slidably retained within the hub. The T-bar assembly can be placed in a stowed position in which the bar is positioned alongside the housing. The wrench also includes magnetic retaining provisions to retain the T-bar assembly in its stowed position.

18 Claims, 9 Drawing Sheets

(56) References Cited

U.S. PATENT DOCUMENTS

| | | | | |
|---|---|---|---|---|
| 6,260,452 | B1 * | 7/2001 | Yu | B25B 23/0021 81/177.2 |
| 6,477,921 | B1 | 11/2002 | Picone | |
| 7,121,172 | B1 * | 10/2006 | Daniels | B25B 13/28 81/177.2 |
| 9,381,628 | B1 * | 7/2016 | Garza | B25G 1/043 |
| 2004/0139828 | A1 * | 7/2004 | Chang | B25B 13/461 81/177.9 |
| 2006/0207393 | A1 * | 9/2006 | Stupar | B25G 1/025 81/177.75 |
| 2007/0256237 | A1 | 11/2007 | Mayer | |
| 2008/0034927 | A1 | 2/2008 | Adkins et al. | |
| 2010/0146801 | A1 * | 6/2010 | Pellenc | B27B 17/14 30/386 |
| 2012/0247279 | A1 * | 10/2012 | Lee | B25G 1/063 81/177.7 |

OTHER PUBLICATIONS

Extended European Search Report (EESR) dated Aug. 9, 2016; Application 13848146.0; 8 pages.

* cited by examiner

BASIN WRENCH

CROSS REFERENCES TO RELATED APPLICATIONS

This application claims priority from U.S. provisional application Ser. No. 61/719,058 filed on Oct. 26, 2012.

FIELD

The present subject matter relates to hand tools and particularly those for use in plumbing applications. More specifically, the present subject matter relates to basin wrenches.

BACKGROUND

Basin nuts used to secure kitchen and vanity faucets, kitchen spray hoses, toilet ballcocks and the like usually are located in confined areas that are difficult to engage with a wrench. Many plastic nuts have wings or flanges to facilitate turning of the nuts by hand. In many cases, however, it still is necessary to use a wrench with such nuts to ensure tightness and also to loosen nuts which may have become "frozen" in place either through over-tightening or as a result of dissolved salts or minerals in the water. For example, the space under sinks is very limited due to an enclosed area having a plurality of supply lines, a drain assembly and other such obstacles thus making simple operations like disconnecting a supply line difficult with wrenches that are positioned to extend perpendicular to the fitting. Removing an old faucet and installing a new one is typically very difficult without a basin wrench (also referred to as a faucet wrench). A basin wrench is a plumbing tool for removing and installing sink faucets and is often used in such instances. A basin wrench generally has a long handle that is directed upward from under a sink to turn nuts on fittings and faucets. A basin wrench is normally used to loosen or tighten locknuts for supply hoses attached to compression fittings.

In order to remove/install a faucet on a working sink it is necessary to loosen/tighten nuts that are located underneath and behind the sink bowl. Not only is it necessary to twist one's body into a small space, an operator must typically lay on his or her back and limited working space exists around these locking nuts. Moreover, when working in such difficult to access positions, such as under sinks, it is usually dark and difficult to see. Thus, users are forced to provide some sort of lighting to enable them to see what they are doing. This is often accomplished by balancing a flashlight under the sink so that the light is focused on the desired location. However, such undertaking is cumbersome and many times results in the flashlight falling over. Also, it requires the user to carry a flashlight, in addition to all of the other tools, to the work location.

Although basin wrenches are known in the art, most include one or more metal members as a handle and can be difficult to grasp particularly if water, oils, or other contaminants are deposited thereon. In addition, if an auxiliary cross handle is provided such as for facilitating rotation of the wrench, the outwardly extending cross handle renders the wrench difficult to store in a tool box or other small space.

Although a variety of basin and faucet wrenches are known in the art, a need remains for a basin wrench that further promotes ease and convenience of use, facilitates engagement and gripping of fittings or other components, is relatively compact when not in use, and which ergonomically combines multiple features in a single device which can be economically manufactured.

SUMMARY

The difficulties and drawbacks associated with previously known tools are addressed in the present subject matter basin wrenches.

In one aspect, the present subject matter provides a basin wrench comprising a telescoping support assembly. The telescoping support assembly defines a distal end and an opposite proximal end. The telescoping support assembly defines a longitudinal axis. The basin wrench also comprises a head extending from the distal end of the support assembly. The wrench additionally comprises a lower jaw pivotally attached to the head. The lower jaw is pivotable about a first axis that is perpendicular to the longitudinal axis of the support assembly. The wrench also comprises an upper jaw pivotally attached to the lower jaw. The wrench additionally comprises a T-bar assembly pivotally attached to the proximal end of the support assembly. The T-bar assembly includes a hub defining an aperture extending through the hub and a bar slidingly disposed in the aperture of the hub. The hub of the T-bar assembly is pivotable about a second axis that is perpendicular to both (i) the first axis about which the lower jaw is pivotable relative to the head, and (ii) the longitudinal axis of the support assembly.

In another aspect, the present subject matter provides a basin wrench comprising a telescoping support assembly. The telescoping support assembly defines a distal end and an opposite proximal end. The telescoping support assembly defines a longitudinal axis. The wrench also comprises a lower jaw pivotally attached to the distal end of the support assembly. The lower jaw is pivotable about a first axis that is perpendicular to the longitudinal axis of the support assembly. The wrench also comprises an upper jaw pivotally attached to the lower jaw. The wrench also comprises a T-bar assembly pivotally and removably attached to the proximal end of the support assembly. The T-bar assembly includes a hub defining an aperture extending through the hub and a bar slidingly disposed in the aperture of the hub. The hub of the T-bar assembly is pivotable about a second axis that is perpendicular to both (i) the first axis about which the lower jaw is pivotable, and (ii) the longitudinal axis of the support assembly. The wrench also comprises a housing generally enclosing the support assembly. The housing defines a gripping region. The housing is formed from a polymeric material. The wrench also comprises a light assembly incorporated within the housing and located such that upon emission of light from the light assembly, emitted light irradiates at least a portion of the lower jaw and the upper jaw.

In yet another aspect, the present subject matter provides a basin wrench comprising a telescoping support assembly defining a distal end, a proximal end, and a longitudinal axis. The basin wrench also comprises a pair of jaws pivotally attached to each other. The pair of jaws are pivotally attached to the distal end of the telescoping support assembly. The wrench also comprises a polymeric housing generally enclosing the support assembly. The housing defines a front face, an oppositely directed rear face, a first side extending between the front face and the rear face, and a second side extending between the front face and the rear face. The front face includes a contoured gripping region. And, the basin wrench also comprises a swivel handle assembly pivotally and removably attached to the proximal end of the support assembly. The swivel handle assembly includes a hub that is pivotally and removably attached to the proximal end of the support assembly. The hub defines an aperture extending through the hub. The swivel handle assembly includes a bar slidably disposed in the aperture defined by the hub. The swivel handle is positionable between a use position in which the bar is perpendicular to the longitudinal axis of the support assembly and a stowed position in which the bar is parallel to the longitudinal axis of the support assembly.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

Figure 1:
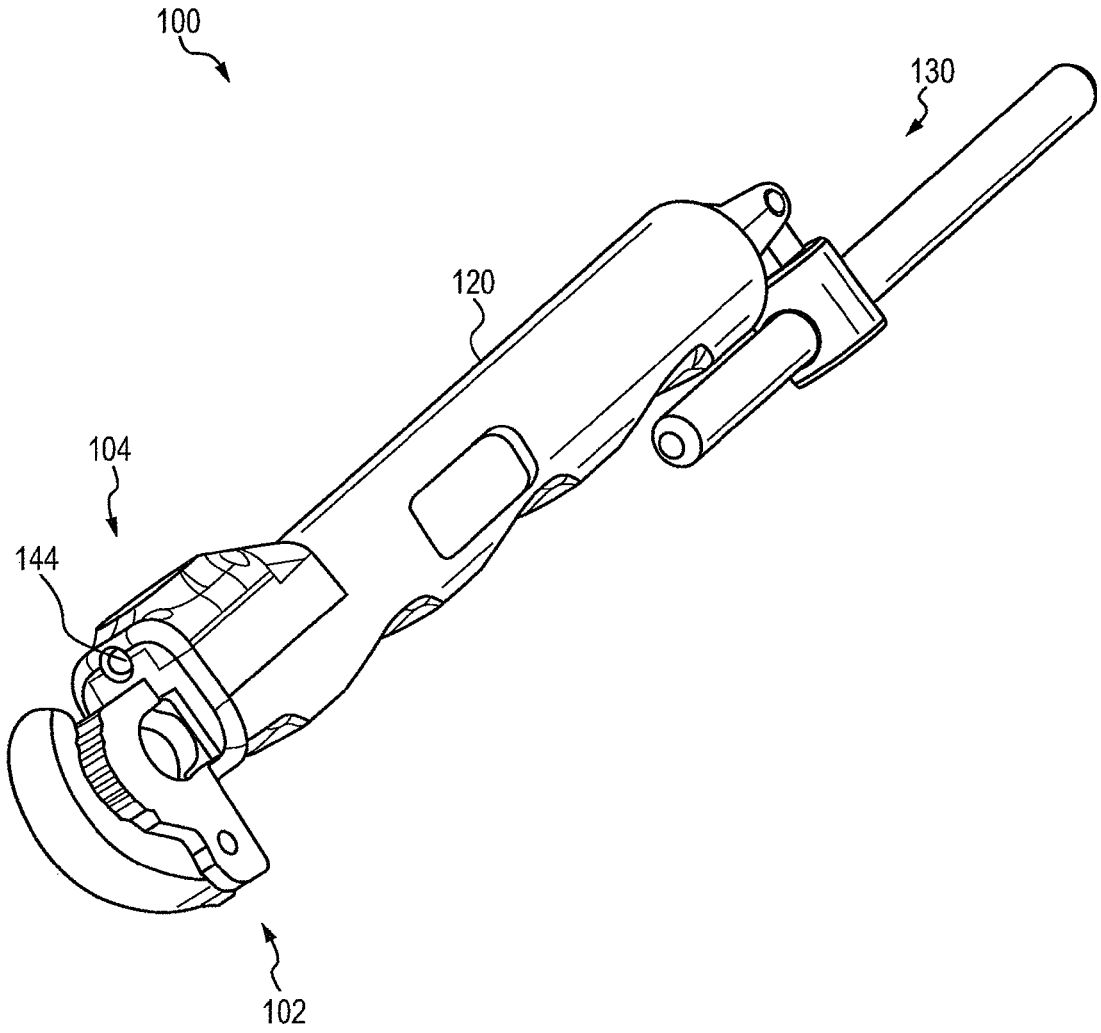
FIG. 1 is a schematic perspective view of an embodiment of a basin wrench in accordance with the present subject matter.

It should be understood that the description and drawings herein are merely illustrative and that various modifications and changes can be made in the structures disclosed without departing from the present disclosure. In general, the figures of the exemplary basin wrench are not to scale. It will also be appreciated that the various identified components of the exemplary basin wrench disclosed herein are merely terms of art that may vary from one manufacturer to another and should not be deemed to limit the present disclosure.

The exemplary basin wrench disclosed herein is useful for rotating fasteners, such as basin nuts that attach a faucet unit to a countertop, for example. The exemplary basin wrench is also useful in many other applications for example tightening ⅞ inch supply line nuts, plastic wing supply nuts, 1 inch supply line nuts (and nuts having other, for example metric, dimensions) and supply line shut-off valves. Accordingly, the present disclosure should not be limited to only a wrench for loosening basin nuts, but instead should be construed broadly.

Referring now to the drawings, wherein like numerals refer to like parts throughout the several views, FIGS. 1-9 illustrate a representative embodiment of a basin wrench 100 according to the present disclosure. Referring to FIGS. 1-4, the basin wrench 100 includes a pivoting head 102 having an engagement member 104 for engaging an item being wrenched or otherwise engaged. The engagement member 104 is provided with two opposed jaws 110 and 112. The first or lower jaw 110 is pivotally affixed to a head 116 extending from a distal end 118 of a housing or handle 120 or a support assembly 150 generally enclosed within the housing, denoted by the dashed line in FIG. 3. The support assembly 150 is described in greater detail herein. The second or upper jaw 112 is pivotally affixed to the first jaw 110 by a pivot pin 122. The first and second jaws can be biased closed by a spring or other biasing member (not shown). Specifically, the second jaw 112 is pivotally movable about the pivot pin 122 in the direction of arrows A shown in FIG. 2. As with conventional basin wrenches, the first and second jaws 110, 112 are matingly curved to fit a range of nuts and include opposing serrations to grip a nut or pipe about which the jaws are placed.

Figure 2:
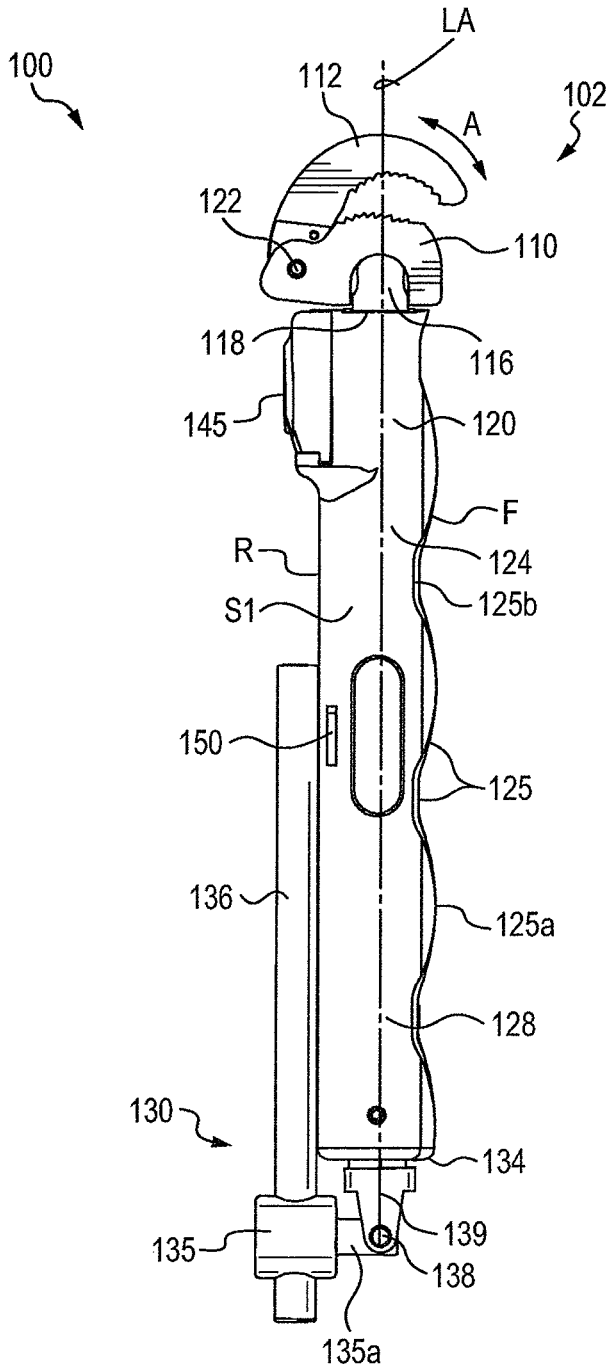
FIG. 2 is a schematic view of a side of the basin wrench depicted in FIG. 1, with a swivel handle in a stowed position.
Figure 4:
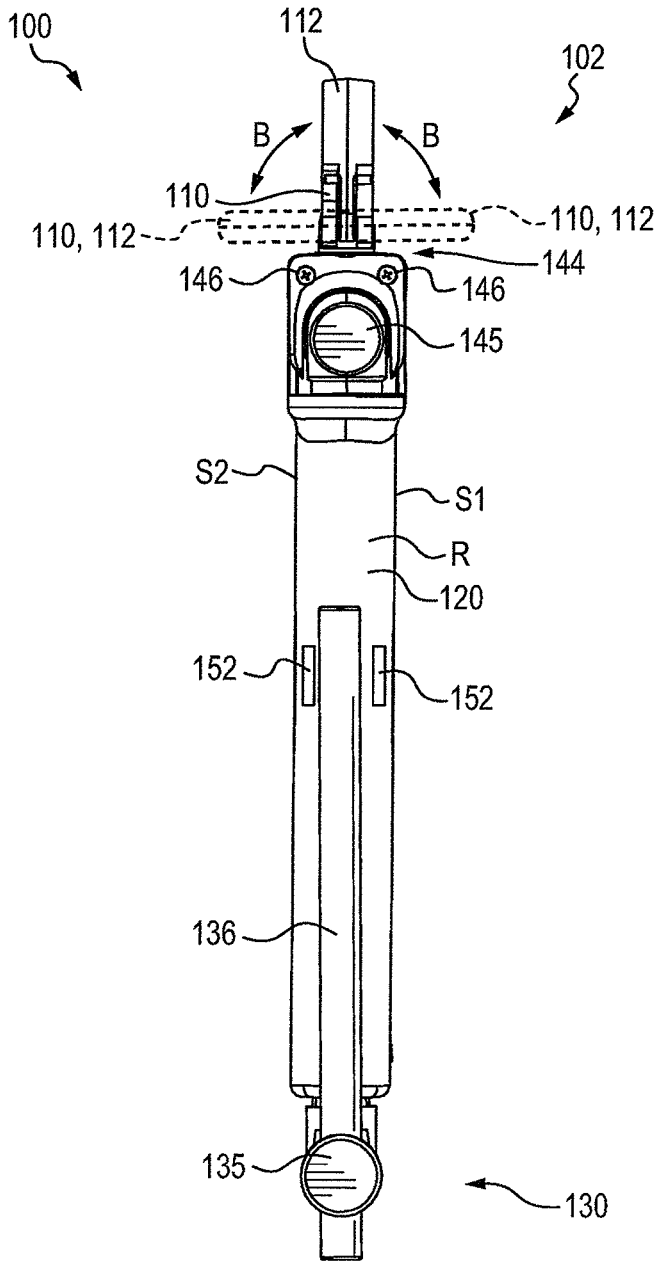
FIG. 4 is a schematic view of a rear face of the basin wrench shown in FIG. 1, with the swivel handle in a stowed position.

The handle 120 includes a fore segment 124, an aft segment 128, and a contoured gripping region 125. The housing or handle 120 defines a front face or region depicted as F in FIG. 2, an oppositely directed rear face or region depicted as R in FIG. 2, and sides S1 and S2 generally extending between the front and rear faces as shown in FIG. 4. In the illustrated embodiment, the gripping region 125 is a region along the outer surface of a front face of the housing or handle 120 that is configured to promote gripping by a user. In the depicted embodiment, the gripping region 125 includes a plurality of alternating ridges **125*a* and depressions 125*b* (best shown in FIG. 2). The basin wrench 100 also comprises a swivel handle 130 (described in greater detail herein) by which a user axially rotates the head 102 about a longitudinal axis defined by the handle 120 and/or the support assembly 150. The longitudinal axis is illustrated in FIG. 2 as LA. In the embodiment illustrated herein, the swivel handle 130 is a T-bar swivel handle located at a proximal end 134 of the handle 120 and/or the support assembly 150. In operation, a user employs the swivel handle 130 as a lever to apply axial torque to the handle 120 and/or the support 150 and the rotational torque is transferred to the head 102**, which, in turn, applies a wrenching torque to a nut, for example.

Figure 5:
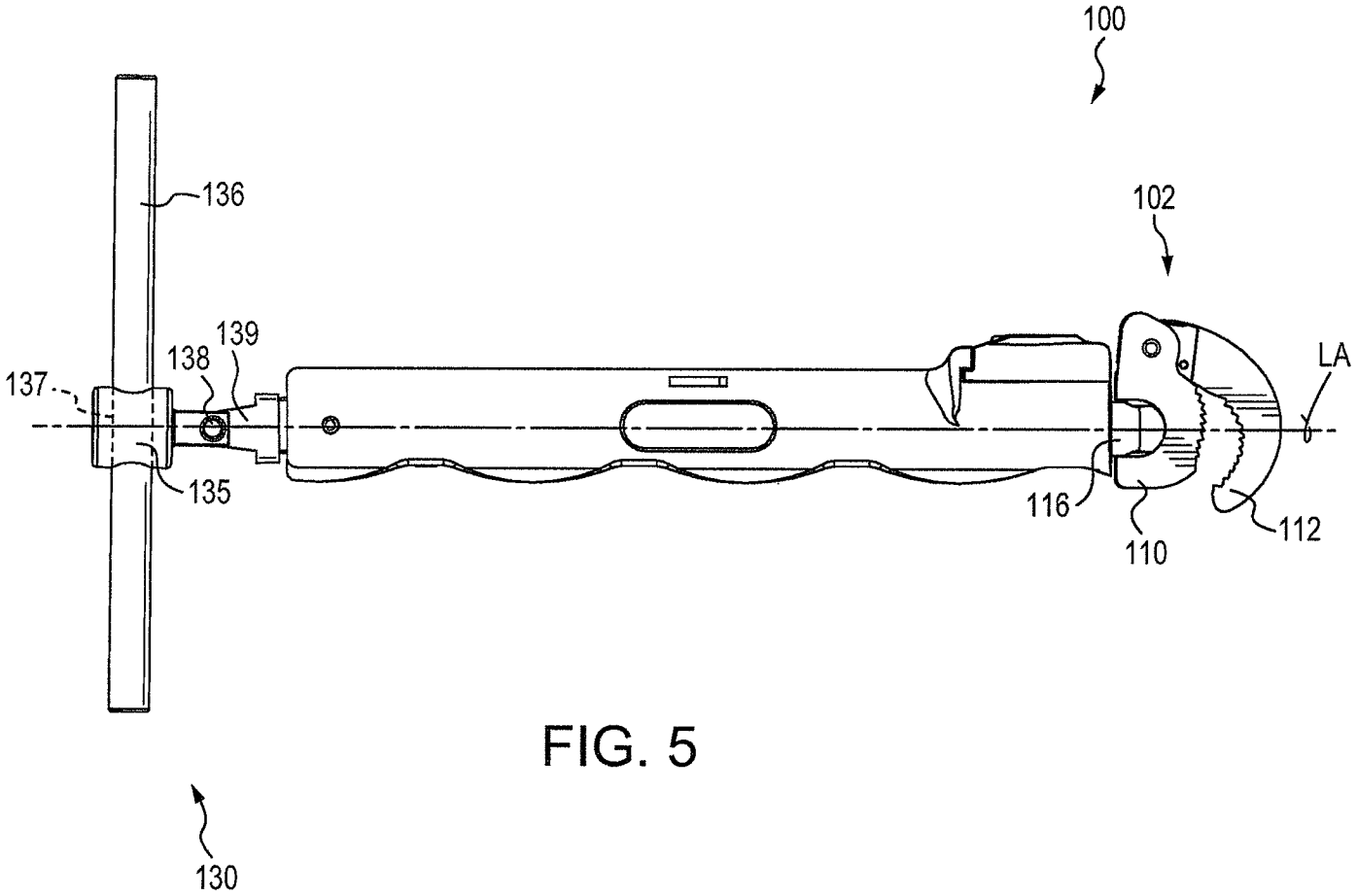
FIG. 5 is a schematic view of a side of the basin wrench depicted in FIG. 1, with the swivel handle in a use position.
Figure 6:
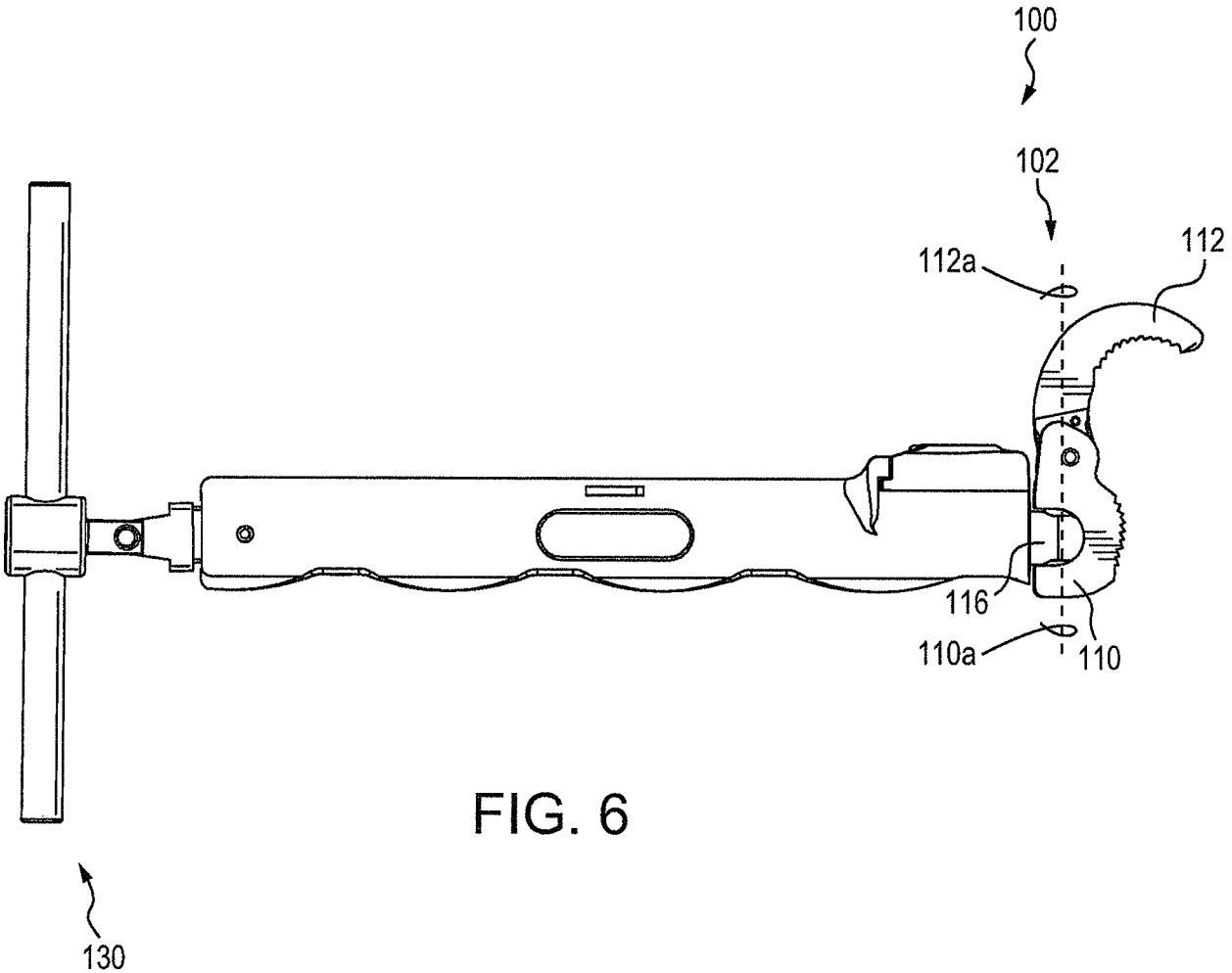
FIG. 6 is a schematic view of a side of the basin wrench depicted in FIG. 1, with a pivotal jaw in an open position.

Referring to FIGS. 4-6, the pivotal action of the jaws 110, 112 is further described. In addition to the pivoting of the upper jaw 112 relative to the lower jaw 110 about the pivot pin 122 in the direction of arrows A in FIG. 2, the jaws 110, 112 also pivot in the direction of arrows B in FIG. 4. Specifically, the lower jaw 110 is pivotally attached to the head 116 and/or the distal end 118 of the housing, handle 120, and/or the support 150 by a pivot pin (not shown) or other member. Specifically, the lower jaw 110 is pivotally movable in the direction of arrows B shown in FIG. 4. The axis of pivoting of the lower jaw 110 relative to the handle 120 and/or support 150 is perpendicular to the axis of pivoting of the upper jaw 112 relative to the lower jaw 110 via pivot pin 122. In certain embodiments, the axis of pivoting of the lower jaw 110 relative to the handle 120 and/or support 150 is also perpendicular to the longitudinal axis LA. As the lower jaw 110 may be pivotally positioned through an angle of about 180° as shown in FIG. 4, the upper jaw 112 is carried with the lower jaw 110 via its attachment from the pivot pin 122. Thus, both the upper jaw and the lower jaw 110 are pivotally positionable in the direction of arrows B. One or more springs or other biasing members or biasing assemblies can be incorporated within the wrench 100 to bias the jaws 110, 112 to the position shown in FIG. 4 in which the jaws 110, 112 generally extend along the longitudinal axis of the handle 120 and/or the support 150.

As previously described, the jaws 110, 112 are pivotally attached to one another so that the jaws can be positioned to a fully open state such as shown in FIG. 6 in which the upper jaw 112 is angularly displaced approximately 180° apart from the lower jaw 110 as measured from axes taken with respect to their base portions, schematically depicted in FIG. 6 as axes 110*a* and 112*a*.

In certain embodiments such as the wrench 100, a light assembly 144 (see FIG. 1) is incorporated within the handle 120. The light 144 is oriented to direct a light beam or other light pattern toward the head 102 to enhance the visibility of the area within which the user is working. Specifically, the light 144 is configured such that upon emission of light, the emitted light irradiates at least a portion of the lower jaw 110 and the upper jaw 112. The light 144 can be battery operated and substantially thin and compact; although, this is not required. In a particular version of the basin wrench, the light includes an LED element for emitting light. A commercially available 3V lithium battery designated as 2032 available from Eveready Battery under the ENERGIZER designation can be utilized for providing electrical power. Associated electronic circuitry and an actuation switch 145 (see FIG. 4) are incorporated within the housing or handle 120. In this embodiment, the switch 145 is provided along a rear face or region of the wrench 100. The light 144 can be configured to provide illumination for a preset time period to thereby preserve battery life in the event the operator neglects to turn the light off. A representative time period is from about 1 minute to about 10 minutes, and typically 5 minutes. It is also contemplated that the light 144 can be configured to flash prior to approaching expiration of the time period to indicate to the operator that the light will turn off shortly. In certain versions of the basin wrench, the light assembly 144 includes intensity adjustment provisions such that a user can select between different levels of light intensity. For example, the light 144 can be configured to provide two intensity levels such as "high" and "medium." A greater number of intensity levels may also be provided. Alternatively, the light could utilize a single intensity level. In the representative embodiment 100, the light 144 and associated components are retained within the handle 120 within a dedicated interior compartment which can be accessed by removal of fasteners 146 (FIG. 4) for example. The battery can also be accessed such as for replacement via removal of the fasteners 146. It should be appreciated that other suitable retaining means known in the art may, alternatively, be used for incorporating the light 144 within the handle 120.

It is also contemplated that the frontwardly directed gripping region 125 can be adapted to include an actuator or push button switch (not shown) which is electrically connected to the light 144, instead of the previously noted rearwardly directed switch 145. Depression of a button along the gripping region 125 actuates the light, and the light 144 can direct a light beam toward the head 102 to enhance the visibility of the area within which the user is working.

As previously described, the swivel handle 130 promotes gripping or handling of the wrench 100 by an operator to thereby apply torque to the head 102 of the wrench. In the particular embodiment illustrated and described herein, the swivel handle 130 is in the form of a T-bar assembly including a hub 135 and a bar 136 which extends through and is slidingly disposed in an aperture 137 defined in the hub 135 (best shown in FIG. 3). The bar 136 may be provided with thickened end regions or outwardly extending members that prevent separation of the bar from the hub aperture 137. The hub 135 of the T-bar assembly is pivotally attached to a proximal end 134 of the handle 120 and/or the support 150. The hub 135 is pivotally positionable about a pivot pin 138 and thus an axis defined by that pin which is perpendicular to both the axis about which the lower jaw 110 is pivotable and the longitudinal axis LA. More specifically, the hub can include an arm member 135*a* (see FIG. 2) that is pivotally attached to a yoke 139 via the pivot pin 138. This configuration facilitates a compact storage position for the wrench 100 as follows.

Figure 3:
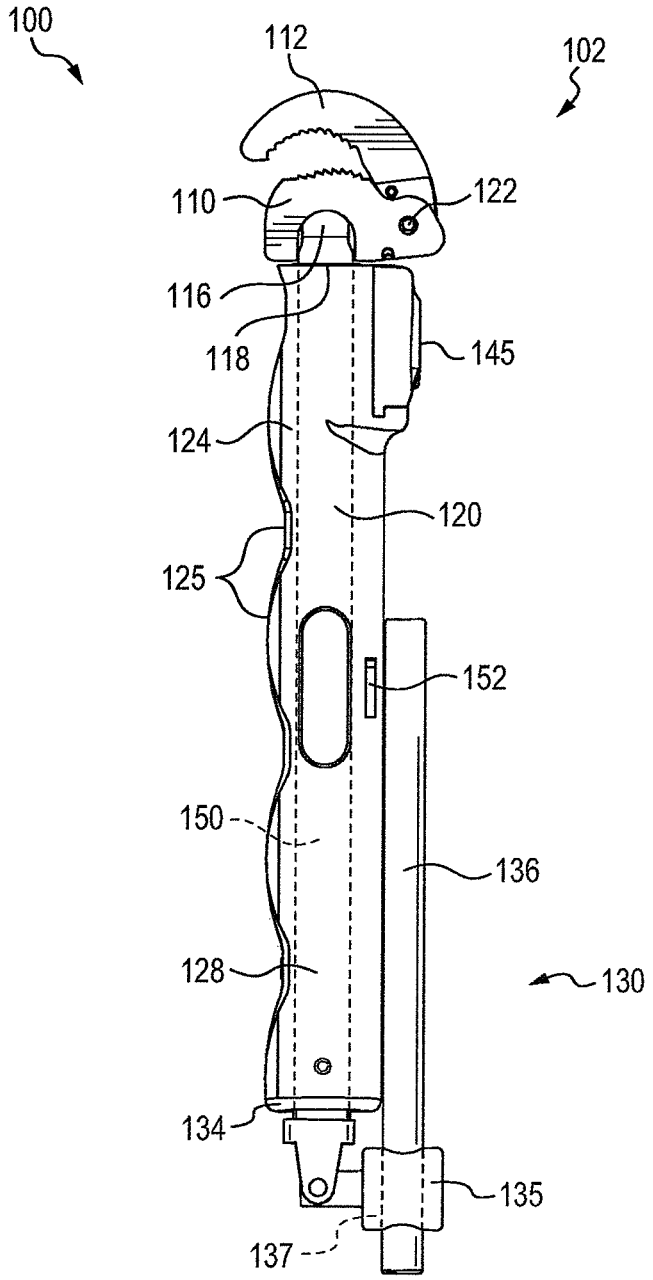
FIG. 3 is a schematic view of another side of the basin wrench shown in FIG. 1, with the swivel handle in a stowed position.

In a particular version of the present subject matter, the swivel handle 130 is positionable between a use position such as depicted in FIG. 5 and a stowed position such as shown in FIGS. 2-4. When the swivel handle 130 is placed in its stowed position, the bar 136 is oriented to a position that is generally parallel to the longitudinal axis LA of the handle 120 and/or support 150, as depicted in FIGS. 2-4. In this stowed position, an axis defined by the aperture 137 is parallel or substantially so with the longitudinal axis LA. In certain embodiments, the length portion of the bar 136 that extends along the rear face R of the handle 120 contacts that face along the entirety of that portion. Specifically, in positioning the swivel handle 130 to its stowed position, the hub 135 and its arm 135*a* are pivoted about the pin 138 to a position generally perpendicular to the longitudinal axis LA as shown in FIG. 2. The bar 136 is slidably displaced relative to the hub 135 such that at least a portion of the length of the bar 136 is positioned along a region of the handle and particularly along the rear face of the handle 120. In certain embodiments, at least a portion of the bar 136 is sufficiently close to one or more retaining provisions along a rear face of the handle 120 such that the swivel handle 130 is retained in its stowed position. In particular embodiments such as shown in the referenced figures, a majority portion of the length of the bar 136 is positioned alongside the handle 120 and/or the support 150 as shown in FIGS. 2-4. In such embodiments, the swivel handle 130 is positioned to a stowed position in which the hub 135 is pivoted about the pin 138 such that an axis defined by the aperture 137 of the hub is parallel with the longitudinal axis LA.

In certain embodiments, upon positioning the swivel handle 130 to a use position, the bar 136 is generally perpendicular to the longitudinal axis LA. And, upon positioning the swivel handle 130 to a stowed position, the bar 136 is generally parallel to the longitudinal axis LA.

The representative embodiment basin wrench 100 also comprises retaining provisions for releasably retaining the bar 136 of the T-bar assembly or swivel handle 130 in a stowed position along a region of the handle 120 or support 150. In certain versions of the wrench 100, the retaining provisions of the wrench 100 include one or more magnets disposed within the handle 120 and/or along the support 150 and positioned along a rear face or region of the handle 120 adjacent the bar 136 when the swivel handle and bar are in their stowed position. FIGS. 2-5 illustrate one or more, and particularly a pair, of magnets 152 located along a rear face or region of the handle 120 and proximate the bar 136 when stowed. The magnets 152 are located or otherwise positioned such that upon placing the swivel handle 130 in its stowed position, at least a portion of the bar 136 (if including one or more ferromagnetic materials such as iron) is urged or otherwise pulled toward the magnet(s) 152.

In certain embodiments, the wrench 100 includes the support assembly 150 and a polymeric handle or handle assembly 120 formed or generally enclosing the support 150. Typically, the polymeric handle 120 is engaged with or otherwise secured to the support 150. The polymeric handle 120 is typically molded or otherwise formed to provide an attractive, aesthetically pleasing appearance and include one or more regions such as the previously described contoured gripping region 125. The handle 120 can incorporate the previously noted light assembly 144. The handle 120 can also include the one or more magnets 152 to magnetically retain the bar 136 of the swivel handle 130. The handle 130 can in certain embodiments be directly molded about the support assembly 150 such as for example using over-molding techniques. Alternatively, the handle 120 can be formed separately from the support assembly 150 such as by injection molding techniques, and then assembled about the support 150. Although a wide array of polymeric materials could be used for the handle or handle assembly 120, a glass filled nylon material has been found to be rugged, durable, and provide resistance to wear and impacts.

FIG. 5 illustrates the swivel handle 130 in a use position in which the hub 135 is pivoted so as to extend outward from the handle 120 generally along the longitudinal axis LA of the handle 120. The bar 136 is slidably positioned within the aperture 137 defined in the hub 135 such that equal or substantially equal lengths of the bar 136 extend outward from both sides of the hub 135. Rotation of the swivel handle 130 about the longitudinal axis LA of the handle 120 and/or support 150 results in rotation of the head 102 and thus the jaws 110, 112 also about the longitudinal axis LA.

In certain embodiments the swivel handle 130 is removable from the handle 120 and/or the support 150. The swivel handle 130 and the proximal end 134 of the wrench 100 can include a conventional ⅜ inch or ½ inch square socket drive configuration for example. Upon disengagement of the swivel handle 130 from the proximal end 134, the exposed end 134 of the wrench includes a square socket receiving region (not shown) at which a conventional ratchet, extension, and/or breaker bar could be engaged for applying torque to the wrench 100 about the longitudinal axis LA. The present subject matter includes a wide array of releasable engagement provisions between the swivel handle 130 and the proximal end 134 of the wrench.

Figure 7:
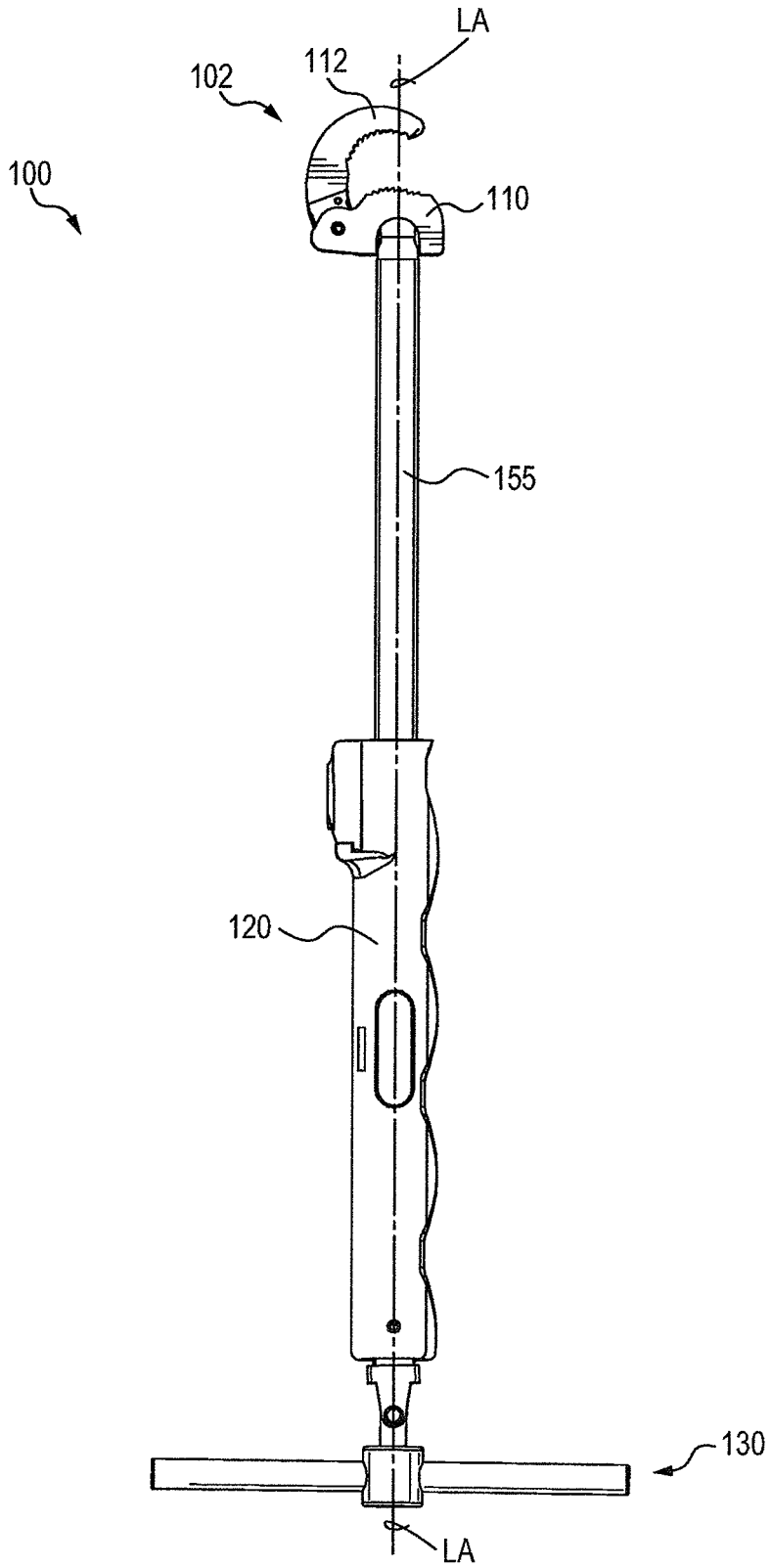
FIG. 7 is a schematic view of a side of the basin wrench of FIG. 1 in an extended, telescoped state.
Figure 8:
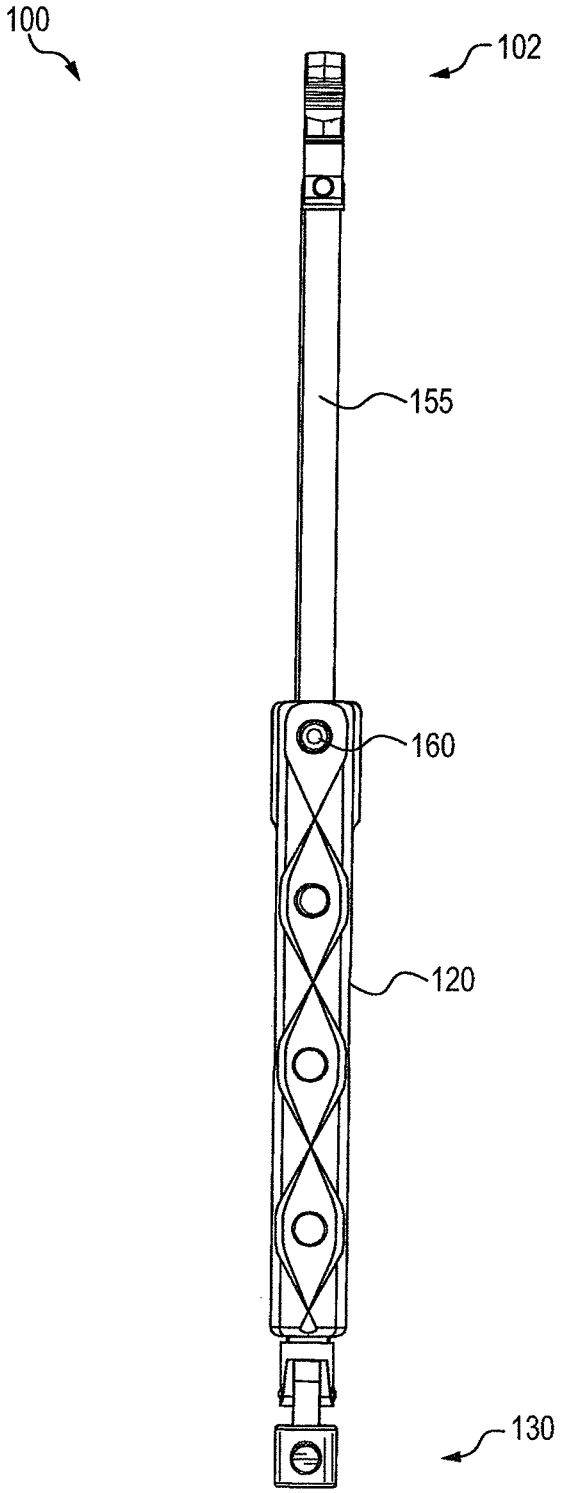
FIG. 8 is a schematic view of a front face of the basin wrench of FIG. 1 in the extended, telescoped state.
Figure 9:
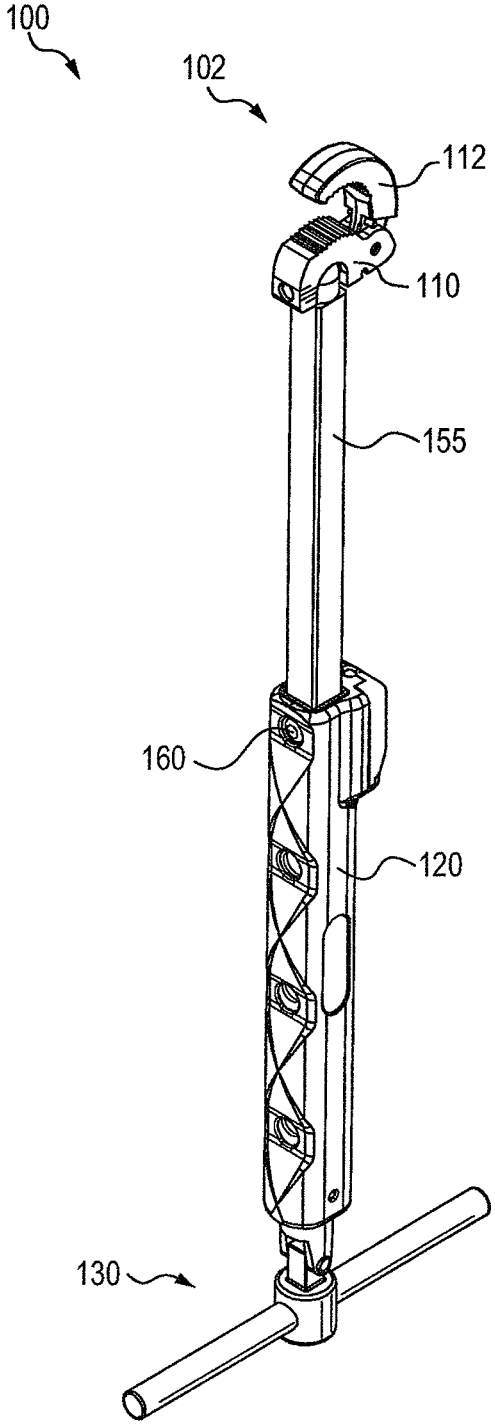
FIG. 9 is a schematic perspective view of the basin wrench of FIG. 1 in the extended, telescoped state.

The basin wrench 100 includes length adjustment provisions configured to adjust a length of the handle 120 and/or the support 150. FIGS. 7-9 illustrate the basin wrench 100 in an extended, telescoped state in which an extension portion 155 retained within the handle 120 and/or the support 150, is extended outward therefrom. The extension portion 155 generally extends along the longitudinal axis LA. Particularly, the handle 120 and/or the support 150, and the extension portion 155 are telescoped together to allow selective variation in the length/height of the basin wrench 100. As shown, the extension portion 155 is sized to be slidingly received within the handle 120 and/or the support 150. In the embodiment shown in FIGS. 7-9, the length adjustment provisions involve the use of a thermoplastic rubber or some other high friction material that suitably binds against, for example, the interior of at least one of the handle/support and extension portion 155. For example, the extension portion 155 can be at least partially coated with the high friction material, and movement of the extension portion 155 relative to the handle/support causes the high friction material to press against an interior wall of the handle/support and thereby bind the handle/support and extension portion 155. A spring loaded detent button 160 accessible along a front face of the handle 120 governs extension and/or retraction of the portion 155. In the wrench embodiment 100, the detent button 160 is engageable with a plurality of openings or apertures provided along the front face F of the handle 120. As illustrated in FIGS. 2 and 9 for example, the apertures can be located in the depressions 125*b*, i.e. one aperture per depression. The outwardly biased detent button 160 is engageable with each of the spaced apart apertures such that as the extension portion 155 travels past a respective aperture, the detent button 160 is urged outward into the aperture thereby "locking" or retaining the selected linear position or length of the handle.

In alternate embodiments, to adjust the overall length of the wrench 100, the handle 120 and/or the support 150 may be provided with spaced openings arrayed along one side of the handle or support. The previously noted detent button 160 can be used to selectively engage the openings for establishing the length of the basin wrench 100. To allow for incremental adjustment in length of the handle 120 and/or support 150, and according to another alternate embodiment of the adjustment mechanism, the extension portion 155 can include a toothed rack which runs a length of the extension portion 155. An end of the extension portion located in the body can include a stop (not shown) to limit extension of the handle beyond a predetermined length. The stop can also prevent the extension portion 155 from being separated from the body handle 120 and/or support 150. A locking pawl (not shown) can be used, which is connected to the end of the body handle/support for selectively engaging the rack. The locking pawl is a biasing, pivoting-mechanism having an end portion configured to engage the teeth of the rack. The end portion of the locking pawl is biased toward the rack. Engagement of the rack by the locking pawl prevents unintended movement of the extension portion relative to the handle/support. However, when the locking pawl is moved to a retracted position, the extension portion is free to move in and out of the body.

In still another alternative embodiment of the adjustment mechanism, instead of the locking pawl, a spur gear might be used with the toothed rack. Rotation of the spur gear via a knob provided on the handle/support could alter the extension of the handle/support and a handle lock can be used to lock (or disengage) such a gear, thereby locking the body and extension portion in place (relative to one another) as well.

In still another alternate embodiment of the adjustment mechanism, one or more threads are provided on an end of the extension portion 155 located in the body handle/support. The end 134 of the body handle 120 and/or support 150 can be configured to engage the thread(s), and rotation of the extension portion 155 about the longitudinal axis LA defined by the handle 120 changes a length/height of the handle. A stop can be provided on the handle and adapted to engage the extension portion and prevent further rotation of the extension portion during use of the basin wrench 100.

It should be appreciated that the embodiments of the length adjustment mechanism described herein are by way of example only and alternative designs which allow for telescoping movement of the extension portion 155 relative to the body handle 120 and/or the support 150 are contemplated for the adjustment mechanism. It should also be appreciated that although the embodiment of the basin wrench 100 described herein includes a length adjustable extension portion 155, it should be understood that the scope of this disclosure includes embodiments of the basin wrench in which the extension portion 155 is not adjustable in length.

Many other benefits will no doubt become apparent from future application and development of this technology.

All patents, published applications, and articles noted herein are hereby incorporated by reference in their entirety.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A basin wrench comprising:

a telescoping support assembly including an extension portion, the support assembly defining a distal end, an opposite proximal end, and a longitudinal axis;

a head extending from the distal end of the support;

a lower jaw pivotally attached to the head, the lower jaw pivotable about a first axis that is perpendicular to the longitudinal axis of the support assembly;

an upper jaw pivotally attached to the lower jaw;

a T-bar assembly pivotally attached to the proximal end of the support assembly, the T-bar assembly including a hub defining an aperture extending through the hub and a bar slidingly disposed in the aperture of the hub;

a housing generally enclosing the support assembly, the housing defining a fore segment located proximate the distal end of the support and an aft segment located adjacent the proximal end of the support, the housing also defining a contoured gripping region, and the extension portion being sized to be slidingly received within the housing;

wherein the hub of the T-bar assembly is pivotable about a second axis that is perpendicular to both (i) the first axis about which the lower jaw is pivotable relative to the head, and (ii) the longitudinal axis of the support assembly; and wherein the T-bar assembly is positionable to a stowed position in which the hub is pivoted about the second axis so that a third axis defined by a central longitudinal axis of the aperture of the hub is parallel with the longitudinal axis of the support assembly, and the bar of the T-bar assembly is displaced relative to the hub so that a majority portion of the length of the bar is positioned alongside the housing, and contacts the housing along the majority length.

2. The basin wrench of claim 1 wherein the housing is formed from a polymeric material, the basin wrench further comprising:

at least one magnet disposed within the housing and located such that upon positioning the T-bar assembly to a stowed position, the bar is magnetically retained along the housing.

3. The basin wrench of claim 1 wherein the housing is formed from a polymeric material, the bar includes a ferromagnetic material, the housing includes at least one magnet disposed within the housing, and the at least one magnet disposed in the housing is located sufficiently close to the bar when positioned in the stowed position alongside the housing such that the bar is magnetically retained alongside the housing.

4. The basin wrench of claim 1 further comprising:

a light assembly including an electrically operated light source, at least one battery, and electrical circuitry, wherein the light assembly is incorporated within the basin wrench and the light source is oriented so as to direct light emitted therefrom towards the lower jaw and the upper jaw.

5. The basin wrench of claim 1 wherein the T-bar assembly is disengageable and separable from the proximal end of the support assembly.

6. A basin wrench comprising:

a telescoping support assembly, the support defining a distal end and an opposite proximal end, the telescoping support assembly defining a longitudinal axis, wherein the telescoping support assembly includes an extension portion;

a lower jaw pivotally attached to the distal end of the support, the lower jaw pivotable about a first axis that is perpendicular to the longitudinal axis of the support assembly;

an upper jaw pivotally attached to the lower jaw;

a T-bar assembly pivotally and removably attached to the proximal end of the support assembly, the T-bar assembly including a hub defining an aperture extending through the hub and a bar slidingly disposed in the aperture of the hub, the hub of the T-bar assembly is pivotable about a second axis that is perpendicular to both (i) the first axis about which the lower jaw is pivotable, and (ii) the longitudinal axis of the support assembly;

a housing generally enclosing the support assembly, the housing defining a gripping region, the housing formed from a polymeric material;

wherein the extension portion of the telescoping support assembly is sized to be slidingly received within the polymeric housing; and wherein the T-bar assembly is positioned to a stowed position in which the bar is oriented generally parallel to the longitudinal axis of the support assembly and at least a majority portion of the length of the bar is both (i) disposed alongside a rear face of the housing and (ii) in contact with the face of the housing.

7. The basin wrench of claim 6 wherein upon positioning the T-bar assembly to the stowed position, the bar is also disposed along a region of the housing that is opposite a contoured front face of the gripping region.

8. The basin wrench of claim 7 further comprising:

retention provisions for releasably retaining the bar of the T-bar assembly in a stowed position along the region of the housing.

9. The basin wrench of claim 8 wherein the retention provisions include at least one magnet incorporated and retained in the housing.

10. The basin wrench of claim 6 wherein the T-bar assembly includes a square socket for removable attachment to the proximal end of the support assembly.

11. The basin wrench of claim 6 wherein the polymeric material of the housing is a glass filled nylon material.

12. The basin wrench of claim 6 further comprising:

a light assembly incorporated within the housing and located such that upon emission of light from the light assembly, emitted light irradiates at least a portion of the lower jaw and upper jaw.

13. A basin wrench comprising:

a telescoping support assembly defining a distal end, a proximal end, and a longitudinal axis;

a pair of jaws pivotally attached to each other, the pair of jaws pivotally attached to the distal end of the telescoping support assembly;

a polymeric housing generally enclosing the support assembly, the housing defining a front face, an oppositely directed rear face, a first side extending between the front face and the rear face, and a second side extending between the front face and the rear face, the front face including a contoured gripping region;

a swivel handle assembly pivotally and removably attached to the proximal end of the support assembly, the swivel handle assembly including a hub that is pivotally and removably attached to the proximal end of the support assembly, the hub defining an aperture extending through the hub, and a bar slidably disposed in the aperture defined by the hub, wherein the swivel handle assembly is positionable between a use position in which the bar is perpendicular to the longitudinal axis of the support assembly and a stowed position in which the bar is parallel to the longitudinal axis of the support assembly;

wherein upon the swivel handle assembly being positioned to the stowed position, at least a majority portion of the bar is positioned both (i) alongside the rear face of the housing and (ii) in contact with the rear face of the housing;

wherein the telescoping support assembly includes an extension portion that is sized to be slidingly received within the polymeric housing.

14. The basin wrench of claim 13 further comprising:

retaining provisions for releasably retaining the swivel handle assembly in the stowed position.

15. The basin wrench of claim 14 wherein the retaining provisions include at least one magnet disposed in the housing and the bar including a ferromagnetic material.

16. The basin wrench of claim 13 wherein the swivel handle includes (i) a yoke releasably engageable with the proximal end of the support assembly, and (ii) an arm extending from the hub and pivotally attached to the yoke.

17. The basin wrench of claim 13 further comprising:

a light assembly incorporated within the housing, the light assembly configured to emit light upon the pair of jaws upon actuation of the light assembly.

18. The basin wrench of claim 13 wherein the gripping region includes a plurality of ridges and a plurality of depressions.

* * * * *